US006517015B2

(12) United States Patent
Rowley, Jr.

(10) Patent No.: US 6,517,015 B2
(45) Date of Patent: Feb. 11, 2003

(54) TWO-STAGE COMMINUTING AND DEHYDRATING SYSTEM AND METHOD

(76) Inventor: Frank F. Rowley, Jr., Rte. 1, 11134 N. Meridian, Valley Center, KS (US) 67147

( * ) Notice: Subject to any disclaimer, the term of this patent is extended or adjusted under 35 U.S.C. 154(b) by 115 days.

(21) Appl. No.: 09/809,845

(22) Filed: Mar. 16, 2001

(65) Prior Publication Data

US 2002/0000485 A1 Jan. 3, 2002

Related U.S. Application Data

(60) Provisional application No. 60/191,076, filed on Mar. 21, 2000.

(51) Int. Cl.[7] ..... B02C 19/06

(52) U.S. Cl. ..... 241/5; 241/29; 241/39; 241/33; 241/152.1

(58) Field of Search ..... 241/29, 152.1, 241/5, 39, 33

(56) References Cited

U.S. PATENT DOCUMENTS

| | | | |
|---|---|---|---|
| 1,830,174 | A | 11/1931 | Peebles |
| 3,794,251 | A | 2/1974 | Williams |
| 3,800,429 | A | 4/1974 | Lindl |
| 3,896,984 | A | 7/1975 | Edwards |
| 3,937,405 | A | 2/1976 | Stephanoff |
| 4,187,615 | A | 2/1980 | Iwata |
| 4,236,321 | A | 12/1980 | Palmonari et al. |
| 4,304,360 | A | 12/1981 | Luhr et al. |
| 4,390,131 | A | 6/1983 | Pickrel |
| 4,478,862 | A | 10/1984 | Greethead |
| 4,505,051 | A | 3/1985 | Herchenbach et al. |
| 4,532,155 | A | 7/1985 | Golant et al. |
| 4,736,527 | A | 4/1988 | Iwamoto et al. |
| 4,756,093 | A | 7/1988 | Heinemann et al. |
| 4,978,076 | A | 12/1990 | Andrews et al. |
| 5,012,619 | A | 5/1991 | Knepprath et al. |
| 5,068,979 | A | 12/1991 | Wireman et al. |
| 5,074,476 | A | 12/1991 | Mund |
| 5,096,744 | A | 3/1992 | Takei et al. |
| 5,102,055 | A | 4/1992 | Buschmann et al. |
| 5,143,303 | A | 9/1992 | Niemi |
| 5,236,132 | A | 8/1993 | Rowley, Jr. |
| 5,346,141 | A | 9/1994 | Kim et al. |
| 5,413,285 | A | 5/1995 | Matthews et al. |
| 5,421,524 | A | 6/1995 | Haddow |
| 5,598,979 | A | 2/1997 | Rowley, Jr. |

*Primary Examiner*—Mark Rosenbaum
(74) *Attorney, Agent, or Firm*—Shughart, Thomson & Kilroy; Marcia J. Rodgers, Esq.

(57) ABSTRACT

An improved two-stage comminuting and dehydrating system is efficient, environmentally sound, and may be employed to process sticky materials. The system includes a pair of cyclone structures for comminuting and dehydrating. Injection ports are positioned for injection of viscid substances directly into the low pressure region of each cone. The secondary cyclone structure is equipped with a lower exit port. A single blower is coupled with the cyclone structures to form an air flow loop from the primary cone bottom to the secondary cone top and from the secondary cone top to the primary cone top. Airflow for cycling material between the cones is controlled by feedback from moisture and particle size monitoring devices in a collection unit coupled with the secondary cone.

18 Claims, 7 Drawing Sheets

TWO-STAGE COMMINUTING AND DEHYDRATING SYSTEM AND METHOD

CROSS-REFERENCE TO RELATED APPLICATION

This application claims priority under 35 U.S.C. § 119(e) and 37 C.F.R. 1.78 (a) based upon copending U.S. Provisional Patent Application No. 60/191,076, entitled Comminuting and Dehydrating System and Method, which was filed on Mar. 21, 2000.

BACKGROUND OF THE INVENTION

1. Field of the Invention

The present invention is broadly concerned with comminuting or disintegrating systems, and in particular with a two-staged, closed loop comminuting and dehydrating system.

2. Description of the Related Art

Devices for comminuting and dehydrating are well known. Examples include U.S. Pat. No. 5,236,132 issued to the applicant's assignee on Aug. 17, 1993, and U.S. Pat. No. 5,598,979 issued to the applicant's assignee on Feb. 4, 1997, both of which are incorporated herein by reference. Such prior art comminuting and dehydrating devices comprise a cyclone chamber mounted atop a conical body, an adjustable coaxial sleeve for introducing material to be processed, a damper for reducing air flow through the sleeve, and a blower. A feeder unit is interposed between the blower and the chamber, and material may also be introduced into the chamber through the coaxial sleeve. Processed material may be deposited on a conveyor, pneumatic conveyance system, or collected in an open bin. Such cyclonic comminution devices are suitable for processing materials such as minerals, plants, food products, recyclable materials, and soil.

They may be employed for pulverizing and separating ores such as gold, silver, copper, kaolin and which are recovered from rock formations presenting a different density or structure than the ore. They may also be employed to pulverize and dehydrate materials such as gypsum, fly ash, foundry shag, coal, coke, phosphates and residual products of refining and distillation processes, including animal shells and crustaceans as well as bones, diatomaceous earth and soil structures. They may be employed to pulverize, dehydrate, and preserve food products such as grain, and grain components such as gluten and for fractionalization of the starch protein matrix, as well as for enhancement of lipid or fiber content for further processing or defatting. They may be employed for fragmentation and dehydration of fibrous foods such as carrots, apples, beans, and spinach and for pulverization and dehydration of lignocellulosic biomass materials such as trees, seaweed, straw, peat moss, waste paper and animal wastes. Such cyclonic comminuter dehydrator units may also be employed in recycling for pulverizing glass, metals, plastic and organic materials so that such components may be mechanically sorted and separated. The units may also be used to pulverize and dehydrate soil and to separate it from rock, ash, boron, hydrocarbons and other contaminants, either alone or in conjunction with washing, thermal, biological, or other treatment processes.

However, prior art comminuter dehydrator systems and methods have not been particularly suitable for processing viscid materials such as soil contaminated by petroleum or other chemical spills or animal wastes. Such systems and methods have also not been particularly suitable for delivering particles of a predetermined size and selected moisture content or for preparing uniform homogenous mixtures with consistent predetermined moisture levels.

SUMMARY OF THE INVENTION

The present invention overcomes the problems previously outlined and provides a greatly improved two-stage comminuting and dehydrating system which is efficient, environmentally sound, and which is particularly well adapted for processing liquid or viscid materials to achieve a predetermined particle size and moisture content.

The system includes a pair of cyclone devices for comminuting and dehydrating. Injection ports are positioned for injection of viscid substances directly into the low pressure region of each cone. The secondary cyclone is equipped with a lower exit port. A single blower is coupled with the cyclone structures to form an air flow loop from the primary cone bottom to the secondary cone top and from the secondary cone top to the primary cone top. Airflow for cycling material between the cones is controlled by feedback from moisture and particle size monitoring devices in a collection unit coupled with the secondary cone.

Objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE PREFERRED EMBODIMENTS

Figures 1, 2, 3:
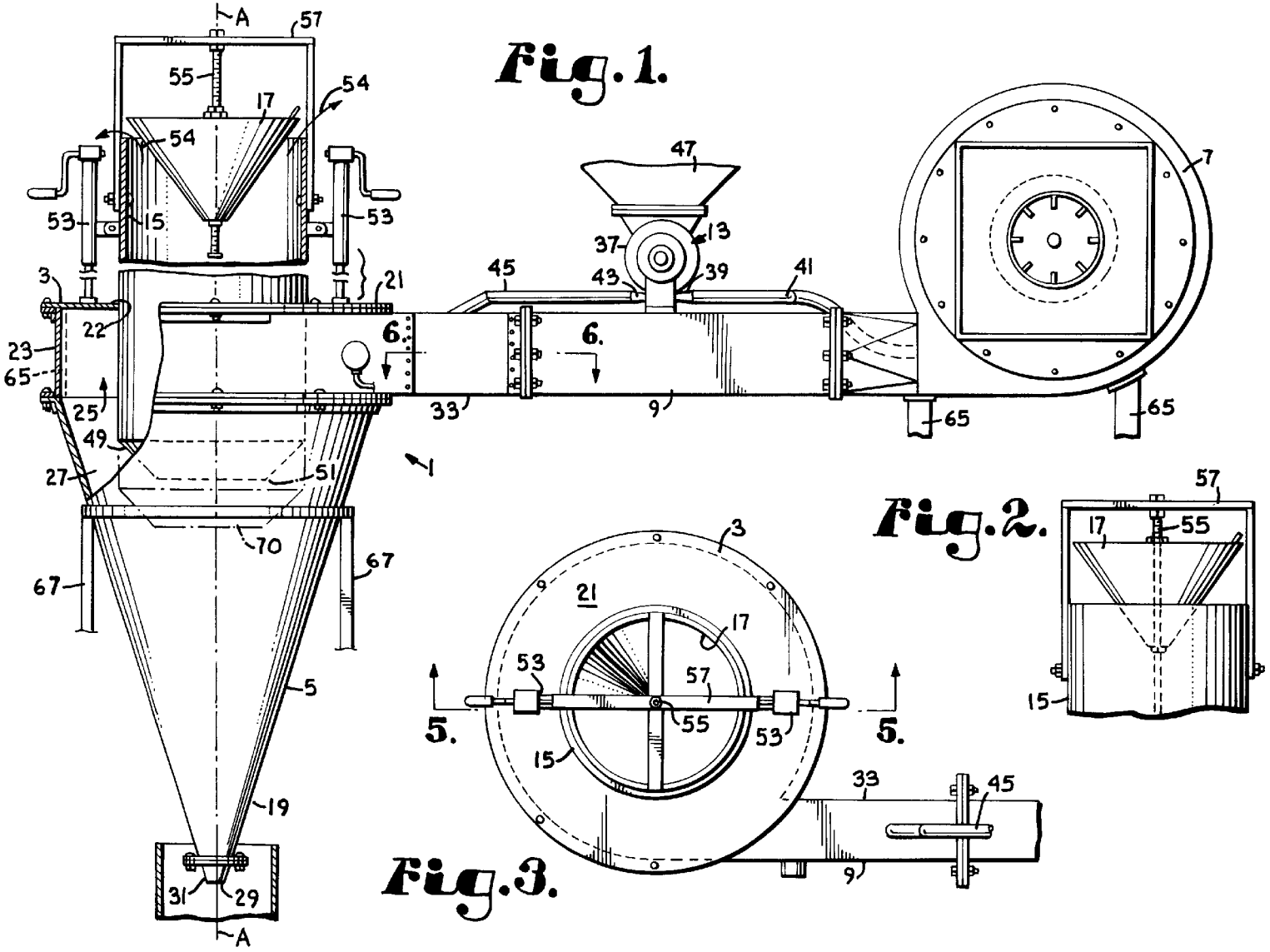
FIG. 1 depicts a fragmentary side elevational view of a gradient-force comminuter/dehydrator apparatus in accordance with the present invention, with parts broken away for clarity and with certain parts shown in phantom.
FIG. 2 is a fragmentary view of the device of FIG. 1, showing a damper thereof.
FIG. 3 is a fragmentary, top plan view of the damper of FIG. 2.
Figure 4:
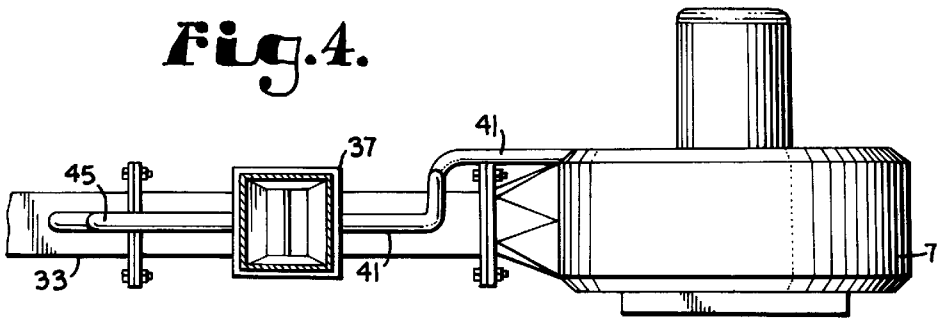
FIG. 4 is a fragmentary, top plan view of a material feeder valve coupled to a blower and manifold of the apparatus.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

I. Comminuter/Dehydrator Apparatus

The reference numeral 1 generally refers to a gradient-force comminuter/dehydrator apparatus for comminuting a variety of different materials having various sizes and various physical characteristics, in accordance with the present invention, as shown in FIGS. 1 through 8. The apparatus 1 comprises a cylindrical chamber 3, a body 5, pressurizing means such as a blower 7 and ducting means 9, air velocity enhancing means such as a venturi mechanism 11, material introducing means 13 for introducing material being comminuted into the apparatus 1, comminuting rate control means and coarseness control means for controlling the rate of comminution of the material being comminuted and the coarseness of the comminuted material such as a sleeve 15 in conjunction with a damper 17, and gravitational discharge means 19 for utilizing gravity to discharge the comminuted material from the apparatus 1.

The cylindrical chamber 3 has a closed, annularly shaped top 21 having a centrally spaced orifice 22, a closed side 23, an open bottom 25, and a generally vertically oriented axis AA, as shown in FIG. 1.

The body 5 has an inverted, conically shaped cavity 27 with base dimensions substantially similar to the inside dimensions of the chamber 3. The body 5 has a truncated lower end 29 and a generally vertically oriented axis which is substantially colinear with the axis of the chamber 3. The body 5 is connected to and suspended generally below the chamber 3. For some applications, the body 5 has one or more detachable nozzles 31, the removal of which provides greater truncation of the conically shaped body 5. Preferably, the conically shaped cavity 27 subtends an angle, as indicated by the arrow designated by the numeral 32 in FIG. 5, within the range of 28° to 42°. More preferably, the cavity 27 subtends an angle of approximately 36°.

The blower 7, such as a Model 602A Pressure Blower as provided by Garden City Fan & Blower Company, provides air at high volume and high velocity. Those skilled in the art will appreciate that blower 7 may be powered by electricity, gasoline, or any other suitable fuel. The ducting means 9 include a manifold 33 for connecting the blower 7 to the chamber 3. In one application of the present invention, the manifold 33 had dimensions of 6½-inches width and 9-inches height. For example, air flow of approximately 1,000–80,000 cfm may be used while maintaining a static pressure of approximately 3–150 inches.

The manifold 33 is connected to the chamber 3 such that air being forced therethrough into the chamber 3 is generally directed substantially tangentially into the chamber 3. To maintain consistency with natural forces, the air is introduced into the chamber 3 on the left side (northern hemisphere) such that the air spirals in a clockwise direction as viewed downwardly.

The venturi mechanism 11 generally includes a pair of opposing, arcuately shaped sidewall plates 34 spaced within the manifold 33 such that a throat 35 is formed therebetween. In one application of the present invention, the throat 35 had a width of approximately 3½ inches. The venturi mechanism 11 is generally spaced in close proximity to the chamber 3.

The material introducing means 13 may include a valve 37, such as a Model VJ8x6 Airlock Valve as provided by Kice Industries, Inc. An input port 39 of the valve 37 is connected to the blower 7 by an upstream pipe 41 such that a portion of the pressurized air being transferred from the blower 7 to the chamber 3 is routed through the valve 37. An output port 43 of the valve 37 is connected to the manifold 33 by a downstream pipe 45 such that material being comminuted and dehydrated by the apparatus 1 is generally directed into the manifold 33 either at, or downstream from, the venturi mechanism 11. A hopper 47 is mounted on the valve 37 such that material being comminuted is gravitationally fed into the valve 37.

The sleeve 15 is generally cylindrically shaped and has an outside diameter dimensioned slightly smaller than the dimensions of the orifice 22. The sleeve 15 extends axially through the chamber 3 and extends into the cavity 27 spaced therebelow. The sleeve 15 includes a truncated, conically shaped flange 49 which has an open lower end 51.

Elevating means, such as a pair of jacks 53 spaced diametrically across the sleeve 15 and generally above the chamber 3, are adapted to cooperatively, axially adjust the sleeve 15 relative to the chamber 3 and the cavity 27.

The damper 17 is adapted to selectively restrict air flowing through the sleeve 7 from the cavity 27 into the ambient atmosphere, as indicated by the arrows designated by the numeral 54 in FIG. 1. The damper 17 is generally threadably mounted on a vertically oriented threaded rod 55 connected to a bracket 57 which is connected to the sleeve 15, as shown in FIGS. 1 and 2, such that the damper 17 is adjustable toward and away from the sleeve 15. Preferably, the damper 17 is configured as an inverted cone. In one application of the present invention, the conically shaped damper 17 subtended an angle of approximately 70°.

The damper 17 generally has slots 59 near the lower extremity thereof. A gate mechanism 61 is adapted to selectively open and close the slots 59 such that selected material being comminuted can pass therethrough. A discharge tube 63 is detachably connected to the damper 17 such that material falling through the slots 59 is gravitationally introduced directly into the cavity 27 as hereinafter described.

In one application of the present invention, the apparatus 1 includes turbulence-enhancing means comprising a plurality of ribs 65. Each of the ribs 65 is generally elongate, having a length approximately equal to the axial length of the chamber 3 and has a roughened surface. The ribs 65 are spaced apart in parallel fashion along the inner perimeter of the chamber 3. Frame means 67 are provided as needed to maintain the various portions of the apparatus 1 in their relative positions and for mounting on a trailer (not shown) for portability, if desired.

In an application of the present invention, the blower 7 is activated such that high volume, high velocity air is introduced substantially tangentially into the chamber 3 whereby that air is further pressurized, cyclonically, in the chamber 3 and in the cavity 27. Due to the centrifugal forces present in the cyclonic environment, the pressure nearer the outer extremities of the cavity 27 is substantially greater than atmospheric pressure, while the pressure nearer the axis of the cavity 27 is less than atmospheric pressure.

Figure 5:
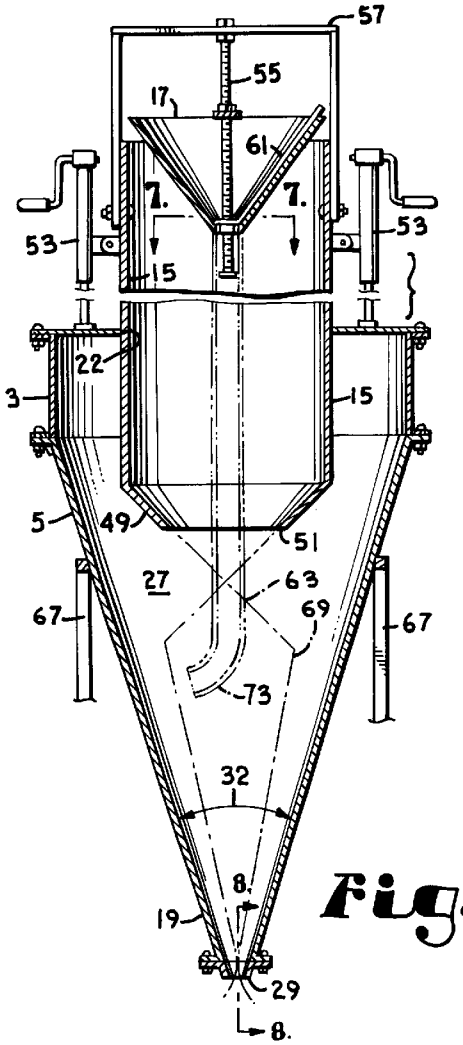
FIG. 5 is an enlarged sectional view taken generally along line 5—5 of FIG. 3.

A profile line, designated by the dashed line designated by the numeral 69 in FIG. 5, indicates the approximate boundary between the region of the cavity 27 having pressures above atmospheric pressure from the region of the cavity 27 having pressures below atmospheric pressure. The pressure-gradient and coriolis forces across and the collision interaction between particles contained in the high-velocity cyclonically pressurized air are violently disruptive to the physical structure of those particles, thereby comminuting and generally dehydrating them.

As the sleeve 15 is lowered by adjusting the jacks 53, as indicated by the phantom lines designated by the numeral 70 in FIG. 1, the profile line 69 moves radially outwardly, providing greater cyclonic velocities and force gradients. Thus, vertical adjustment of the sleeve 15 allows the apparatus 1 to be adapted to accommodate materials having widely different physical characteristics.

The lower the sleeve 15 is spaced relative to the cavity 27, the higher the material being comminuted tends to be distributed in the cyclonic environment of the cavity 27. Also, the lower the relative spacing of the sleeve 15, the greater the cyclonic action within the cavity 27 and, possibly, the greater the suction near the vortex or center of the open lower end 29, as indicated by the arrow designated by the numeral 71 in FIG. 8, causing generally vertical, cochleating and resonating, oscillatory patterns in the air flow containing the material being comminuted to be more violent and thereby affecting the coarseness of the comminuted material. For some applications and configurations of the apparatus 1, the air flow indicated by the numeral 71 may only be nominal.

Similarly, adjusting the damper 17 relative to the sleeve 15, which controls the volume of air allowed to escape from the center, low-pressure region of the cavity 27 into the ambient atmosphere, affects the cyclonic velocities, force gradients, and vertical oscillations as the apparatus 1 is adjusted to handle various throughput volumes of materials being comminuted.

The throughput rate for comminuting the material is controlled by adjusting the rate and manner in which material is being fed into the apparatus 1. If the material is to be both comminuted and dehydrated, then the material is generally fed into the apparatus 1 by the valve 37. In that event, the gate mechanism 61 may be used as a fine control for the coarser adjustments of the damper 17 relative to the sleeve 15.

If the material is relatively fine, such as wheat and the like, and is to be largely comminuted and only minimally dehydrated, then the material may be fed into the apparatus 1 by the damper 17 and the gate mechanism 61 in cooperation with the slots 59. In that event, the material being comminuted falls through the slots 59 and drops gravitationally downwardly through the discharge tube 63 where an elbow 73 injects the material directly into the high cyclonic pressure region of the cavity 27.

Figure 8:
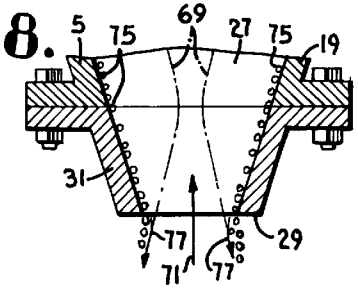
FIG. 8 is an enlarged, fragmentary, partially schematic, sectional view of a nozzle of the device of FIG. 1 taken along line 8—8.
Figure 7:
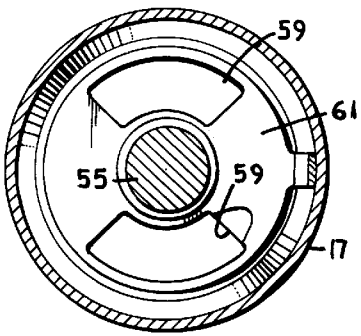
FIG. 7 is an enlarged fragmentary, top plan view of a gate mechanism of the device with parts broken away for clarity, taken along line 7—7 of FIG. 5.
Figure 6:
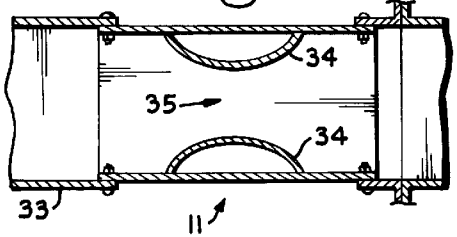
FIG. 6 is an enlarged sectional view taken along line 6—6 of FIG. 1 showing a venturi mechanism thereof.

As the material is comminuted, the finer particles thereof tend to diffuse to the conical perimeter of the cavity 27, as indicated by the numeral 75 in FIG. 8. As those finer particles accumulate, they tend to move gravitationally downwardly to the open lower end 29 where the particles exit from the apparatus 1, assisted by the annularly shaped air leakage from the cyclonically higher pressure region along the perimeter of the cavity 27, as indicated by the arrows designated by the numeral 77 in FIG. 8. By continually feeding material into the apparatus 1, a continuous throughput of comminuted material is provided.

By selectively utilizing the apparatus 1 with and without the nozzle 31, a greater range of sizes and types of materials, and greater throughput rates are obtainable with the apparatus 1.

A container, conveyor belt or other suitable arrangement (not shown) spaced below the lower end 29 receives the comminuted material as it is gravitationally discharged from the apparatus 1.

II. Closed-loop Comminuting and Dehydrating System

Figure 9:
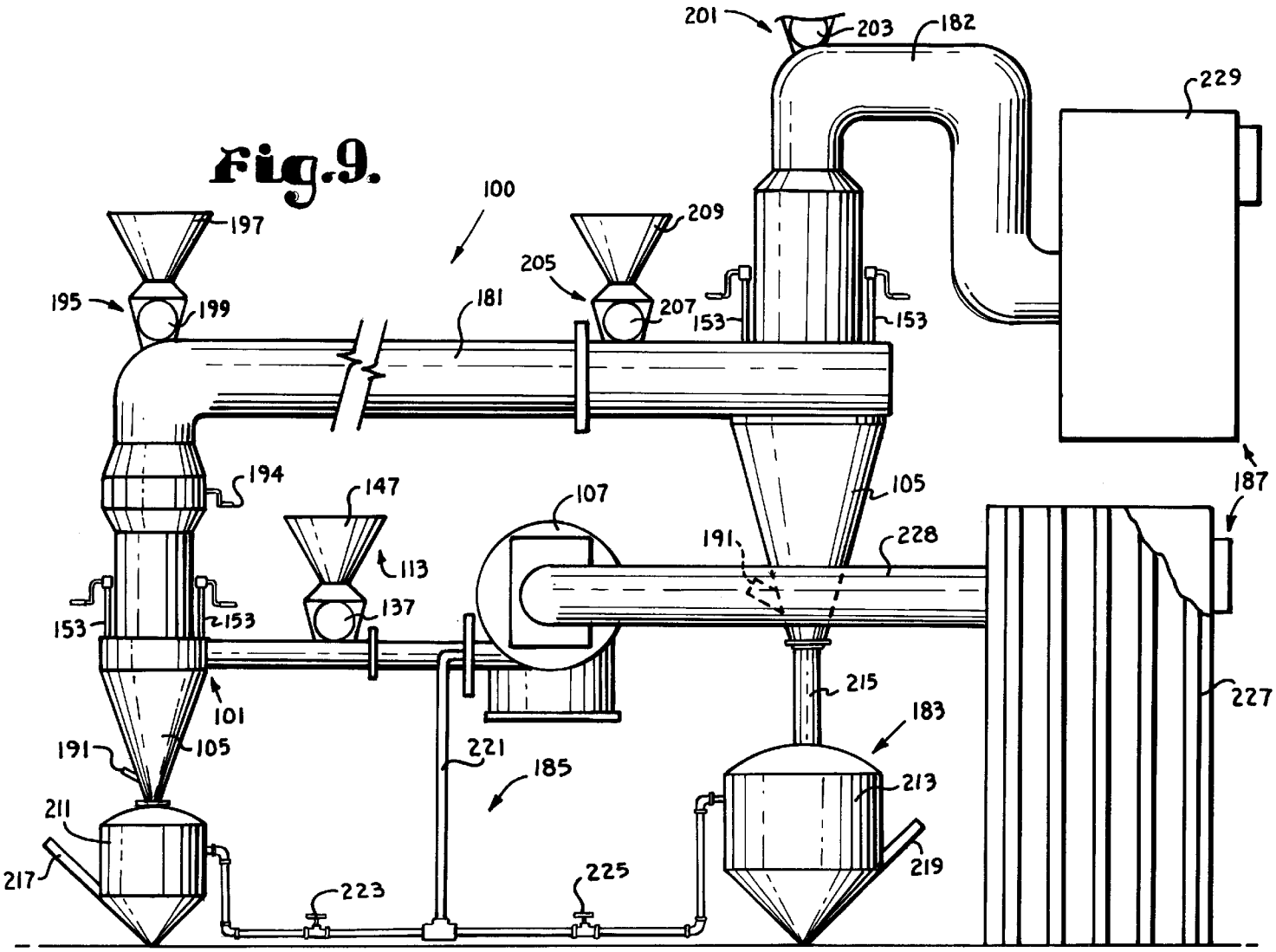
FIG. 9 is a side elevational view of a first alternate embodiment of a closed loop gradient force comminuting and dehydrating system in accordance with the present invention, with material introduction apparatus shown schematically.
Figure 10:
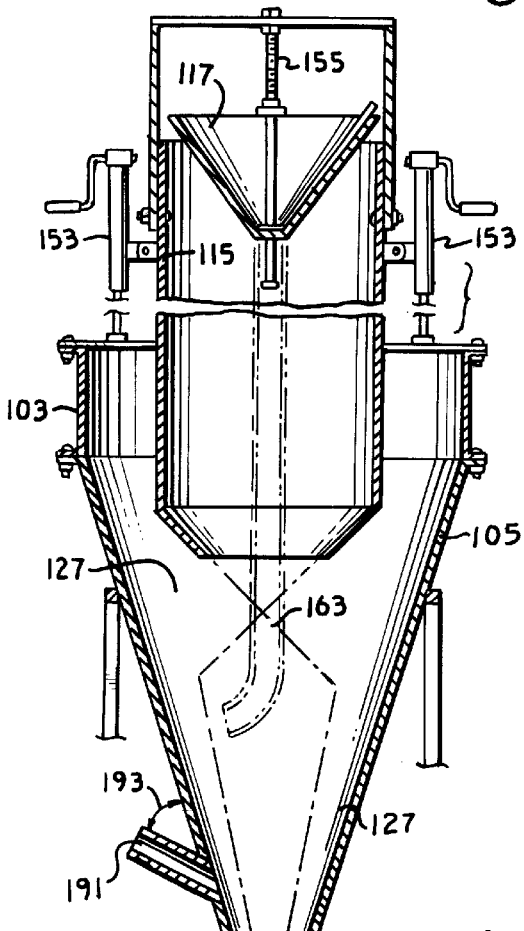
FIG. 10 is an enlarged, fragmentary, sectional view taken generally along line 10—10 of FIG. 9.
Figure 11:
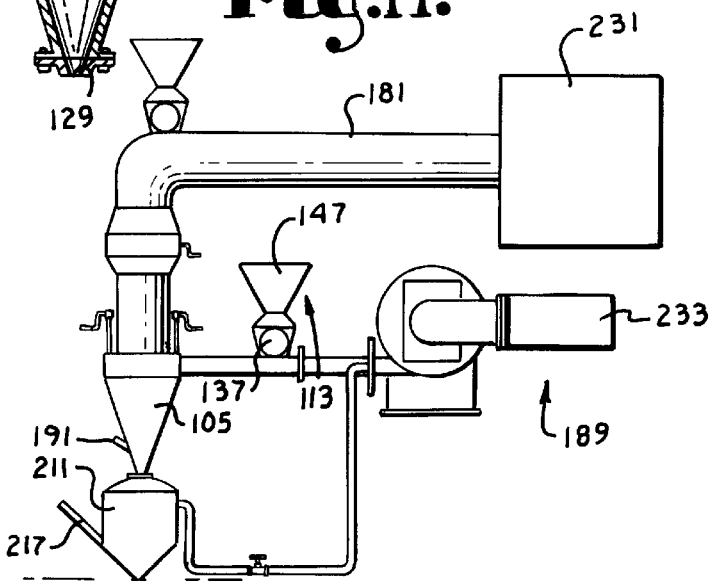
FIG. 11 is a side elevational view of a first alternate embodiment of a closed loop gradient force comminuting and dehydrating system in accordance with the present invention.
Figure 12:
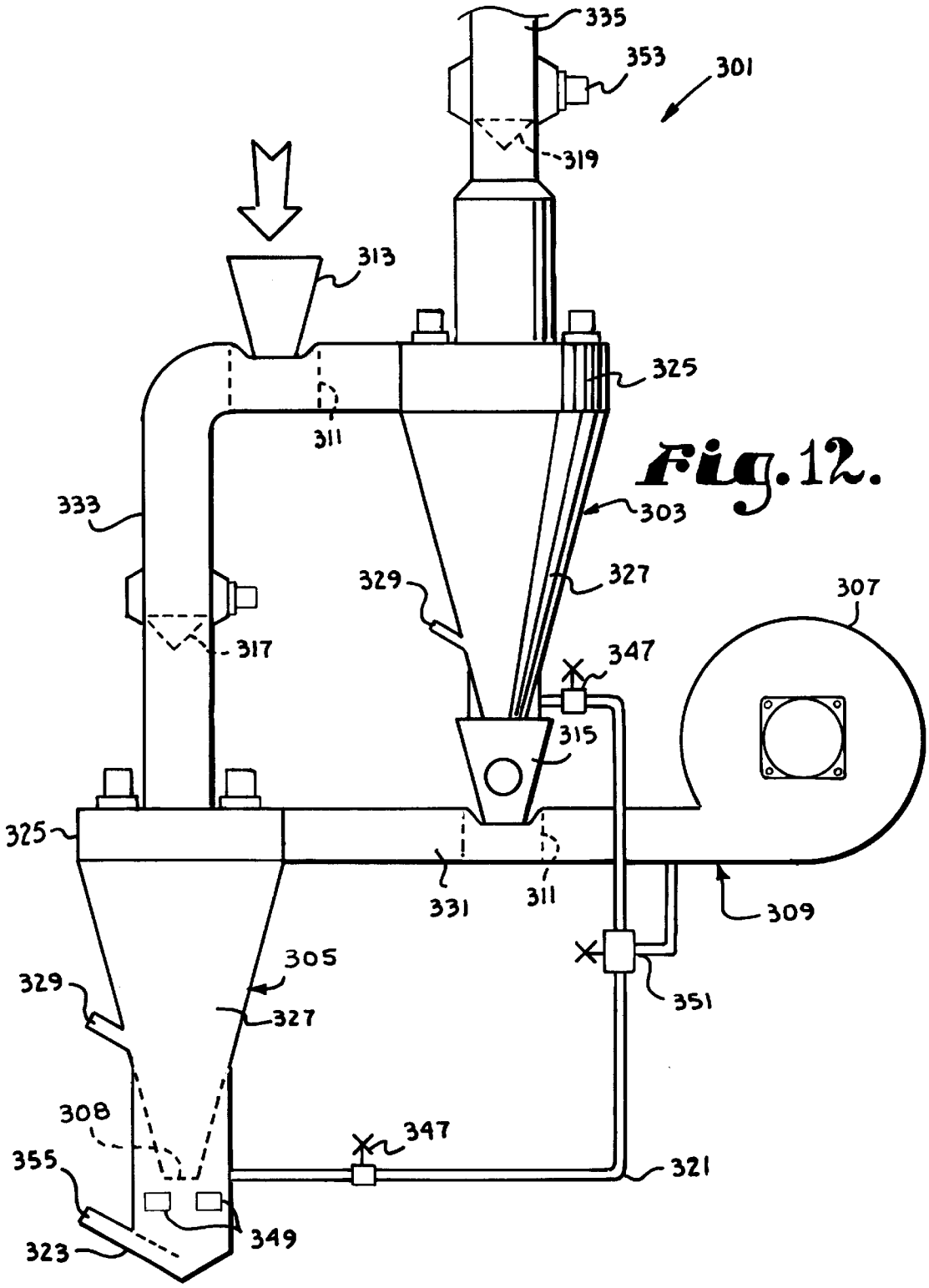
FIG. 12 is a diagrammatic side elevational view of a second alternate embodiment comprising a two-stage comminuting and dehydrating system embodying the present invention.

Referring now to FIGS. 9, 10, and 11, a closed-loop comminuting and dehydrating system 100 includes a primary comminuter/dehydrator apparatus 101 which is substantially similar to the comminuter/dehydrator 1 previously described. The numbering and description of all common elements will not be reiterated. Those elements which are described will be numbered as set forth in FIGS. 1–8 with the addition of 100.

The system 100 also includes a secondary comminuter/dehydrator apparatus 179, a conduit 181 remotely intercoupling the primary and secondary units, a containment system 183, pressure equalization structure 185, filtration system 187, and noise reduction mechanism 189.

Both primary and secondary comminuter/dehydrator units 101, 179 include a material introduction port 191 positioned on the lower portion of the body 105, generally adjacent the low pressure zone of the cyclone. As best shown in FIG. 10, port 191 and body 105 subtend an acute angle 193, so that liquid or viscid materials may be cooperatively introduced by gravity and vacuum directly into the low pressure zone where the product is immediately surrounded by an air envelope and drawn upwardly into the chamber 103. In this manner, the caking problems previously associated with processing liquid and viscid materials are eliminated.

In certain preferred embodiments an extruder apparatus may be coupled with port 191 for metering such liquid or viscid material. The interior surfaces of body 105 may be coated with a "no-stick" material such as a fluorocarbon polymer to further inhibit adhesion of materials to the inner surfaces of the body.

A jack 194 is coupled with damper rod 155 to permit remote adjustment of damper 117. Jack 194 may be operated manually or a hydraulic cylinder or electric screw may be employed. In certain preferred embodiments, both sleeve jacks 153 and system 100 may be provided with one or more pressure sensing devices in the chambers 103 to permit computerized control.

A conduit 181 intercouples primary and secondary comminuter/dehydrator units 101, 179. Conduit 181 fits over sleeve 115 and damper 117 of the primary comminuter/dehydrator unit in sealing relationship and extends in generally horizontal orientation for lateral coupling with chamber 103 of secondary unit 179. Airflow through conduit 181 and into chamber 103 is substantially tangential as previously described with respect to primary unit 101. A similar conduit 182 intercouples secondary comminuter/dehydrator unit 179 with filtering apparatus 187.

Conduit 181 forms an elbow in the region generally above comminuter/dehydrator 101 whereon is coupled a material introduction device 195, depicted schematically in FIG. 9. Device 195 includes a hopper 197 to permit gravitational feeding of material through sleeve 115 and into chamber 103. The device may also be equipped with an airlock valve 199. Similarly, conduit 182 forms an elbow above comminuter/dehydrator 179 whereon is coupled a material introduction device 201, having a hopper (not shown), and which may also be equipped with an airlock valve 203. Generally adjacent secondary comminuter/dehydrator 179, conduit 181 is coupled with a material introduction device 205, equipped with an airlock 207 and hopper 209.

Conduit 181, 182 may be constructed of sheet metal or stainless steel tubing where food materials are to be processed. In especially preferred embodiments the conduit is constructed of ribbed flexible tubing to permit easy assembly and disassembly of the system for portability. The airlock 207 may be operated electrically or by a hydraulic system where the blower 107 is run on fossil fuel.

Containment system 183 includes a pair of generally cylindroconical collection units 211, 213. Primary unit 211 is coupled in sealing relationship with comminuter/dehydrator unit lower end 129. A conduit 215 is employed to intercouple elevated secondary unit 179 with collection unit 213. The conical apex of each unit may be equipped with an airlock device (not shown) to permit additional processing of the comminuted and dehydrated material. Collection units 211, 213 are equipped with material removal ports 217, 219, each of which may be coupled with an auger or vacuum device (not shown) for removal of processed material.

Pressure equalization system 185 includes a conduit 221 and a pair of control valves 223, 225. One end of conduit 221 is coupled with the intake side of blower unit 107 and the other end bifurcates for intercoupling with the upper portion of each collection unit 211, 213.

Filtration system 187 includes a pair of filters 227, 229. Air is drawn through filter 227, into conduit 228, into blower 107 and eventually passes through secondary comminuter/dehydrator unit 179 and out to the atmosphere through filter 229. Filters 227, 229 may be constructed of fibers, charcoal, or any other suitable material. They may be electrostatic for soil remediation uses, or adapted for ozone or other gaseous removal. Where the system is employed for processing foodstuffs such as wheat and the like, the filter material should be capable of removing mold spores. In preferred embodiments each filter 227, 229 comprises a room or "bag house".

The intake portion of blower 107 is coupled with a noise reduction mechanism 189, depicted in FIG. 11 to comprise an attenuator 233. Attenuator 233 mutes the noise produced by high velocity airflow through blower intake. Alternatively as shown in FIG. 9, where a filter room 227 is employed to purify the intake flow of air, the noise is muffled so that an attenuator may not be required. In still other preferred embodiments, both attenuator 233 and filter room 227 may be employed.

Those skilled in the art will appreciate that the closed loop system 100 described herein may comprise more than two comminuter/dehydrator units coupled in series, with airflow produced by a single blower unit. In certain preferred embodiments a single comminuter/dehydrator unit is employed. In such embodiments the output end of conduit 181 may be coupled with a filter room or dust collector or other equipment for further processing of the material as shown schematically at 231. For portability, the system 100 may be mounted on a frame having ground engaging wheels. In such applications conduits 181, 182, 228 may be uncoupled for transport.

In use, high velocity air is drawn through a filter room 227 and introduced into the closed loop system 100 by a single blower 107 in the manner previously described. Airflow in the cyclone structures 101, 179 is regulated by adjustment of sleeve and damper jacks 153, 194 to produce a force gradient adapted to comminute and dehydrate the material to be processed.

Material may be fed into primary cyclone 101 by the hopper 147, through airlock valve 137, and into conduit 109. The material is carried into the cyclone 101 by the high velocity air generated by blower 107. Additional material may be introduced into cyclone 101 by hopper 197, through airlock 199 and into conduit 181. The material falls by gravity through damper 117 and discharge tube 163 into the high cyclonic pressure region of cavity 127. Liquid or viscous materials such as milk whey, eggs, and wheat gluten, materials which have been previously subjected to washing such as mineral slurries, and liquid or viscid additive compositions may be introduced through port 191 directly into the low pressure region of the cyclone, where they are immediately enveloped by dehydrating high velocity air. In this manner material may be dehydrated before coming into contact with the sides of cavity 127, and caking is minimized.

Finer comminuted material settles by gravity into collection unit 211. Adjustment of control valve 223 equalizes the pressure in collection unit 211 so that the processed material may settle easily. The material is removed through port 217 to permit continuous throughput.

Depending on the adjustment of sleeve and damper jacks 153, 194, the pressurized air carries material of a predetermined particle size upwardly though sleeve 115, past damper 117 and into conduit 181. The material is borne along conduit 181 by the high velocity air generated by blower 107 and into secondary comminuter unit 179 for further comminution and dehydration. Material may be fed into secondary cyclone 179 by material introduction devices 201, 205 substantially as previously described. The material falls by gravity through damper 117 and discharge tube 163 into the high cyclonic pressure region of cavity 127. Liquid or viscid materials may also be introduced into secondary comminuter 179 through port 191.

Comminuted material settles by gravity into collection unit 213, which is pressure equalized by adjusting control valve 225. Processed material is removed through port 219 to permit continuous throughput.

Pressurized air containing particles too fine to settle into collection unit 213, passes upwardly from unit 179 and into conduit 182, through a filter room 227, and into the atmosphere.

In other preferred embodiments shown schematically in FIG. 11, the material passes into a dust collector for material classification.

In this manner, the closed loop system 100 employs the spent air from a primary cyclone to drive a secondary cyclone or dust collector unit in an energy efficient process which is environmentally protective and adapted for a wide range of materials including liquid or viscid materials previously unsuitable for cyclonic processing.

III. Two-stage Comminuting and Dehydrating System and Method

Referring now to FIGS. 12–15, a two-stage comminuting and dehydrating system 301 includes primary and secondary comminuter/dehydrator units 303 and 305 which are substantially similar to the comminuter/dehydrator units 1, 101, and 179 previously described. The system 301 also includes a blower unit 307, air delivery conduit 309, venturi mechanism 311 (FIGS. 13 and 14), shredding assembly 312 (FIG. 15), material introduction or entry ports 313 and 315, rate-controlling dampers 317 and 319, pressure control conduit 321, and a material collection unit 323.

The primary and secondary comminuter/dehydrator units 303 and 305 each include a generally cylindrical upper chamber 325, a conical lower body 327 terminating in a material outlet 308 and a viscid material introduction port 329 located adjacent the low pressure zone of the unit at an angle as previously described herein.

The blower unit 307 draws air through an intake filter room, such as previously described and shown, or air may be drawn directly from the atmosphere. The blower unit 307 is coupled with a conduit 309 for carrying the output air in a continuous stream to the chambers 325 of comminuter/dehydrator units 303 and 305.

The conduit 309 includes a first leg 331 which extends laterally below the primary comminuter 303 for coupling with the upper chamber 325 of the secondary comminuter/dehydrator unit 305. A secondary material introduction port or airlock 315 communicates between the primary comminuter lower body 327 and the conduit first leg 331. A second conduit leg 333 is coupled with the upper chamber 325 of the secondary cyclone structure 305. The second conduit leg 333 extends generally upwardly through a damper 317 and forms an elbow return for coupling with the upper chamber 325 of the primary cyclone structure 303. The return portion of the second conduit leg 333 includes the primary material introduction port 313 for introduction of materials to be processed. A spent air discharge conduit leg 335 extends upwardly through a damper 319 from the upper chamber 325 of the primary comminuter/dehydrator 303. This discharge conduit 335 may be coupled with a baghouse or other suitable filter such as previously shown, described and designated by the reference numeral 229.

Figure 14:
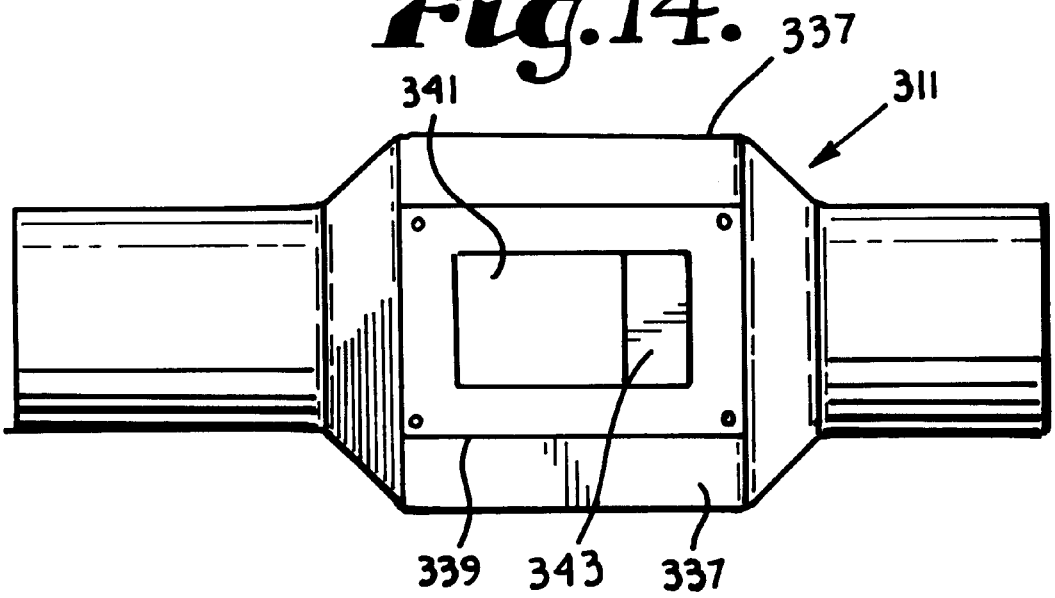
FIG. 14 is an enlarged fragmentary diagrammatic top plan view of the venturi mechanism of FIG. 13.
Figure 13:
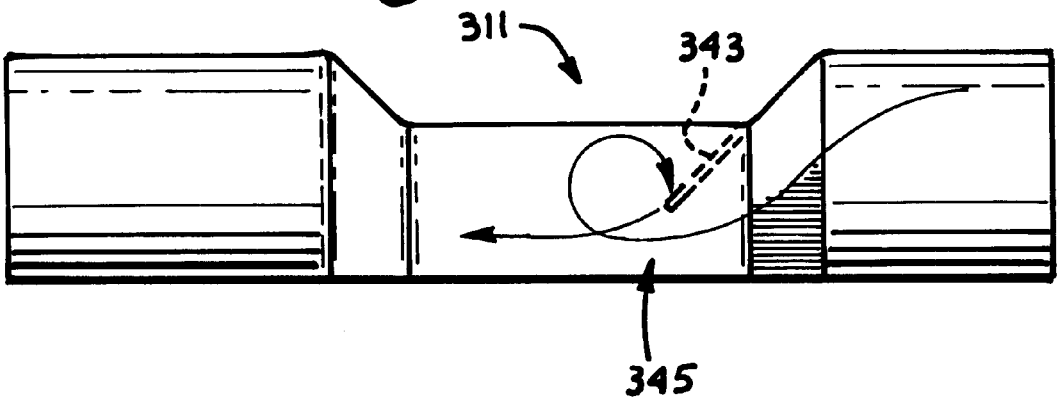
FIG. 13 is an enlarged fragmentary diagrammatic side elevational view of a segment of the conduit second leg as shown in FIG. 12 showing airflow through a venturi mechanism thereof.
Figure 15:
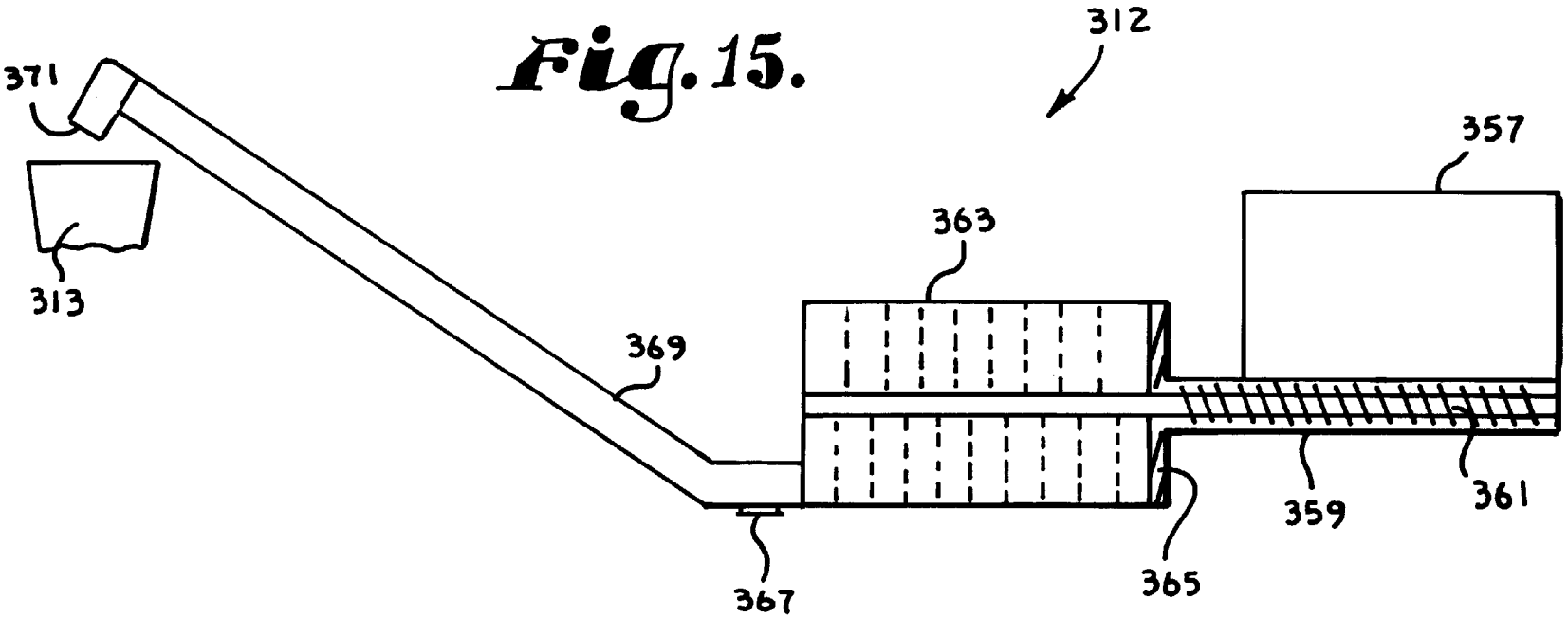
FIG. 15 is a diagrammatic side view of a shredding/drying assembly shown in position for delivery of shredded material to a primary airlock of the embodiment of FIG. 12.

Each material introduction airlock port 313 and 315 is coupled with a venturi mechanism 311, depicted in FIGS. 13 and 14. The venturi mechanism 311 includes a laterally expanded baffle tube 337, having a generally planar upper surface or plate 339 for receiving a respective airlock port 313 or 315, which is held in place by fasteners, such as bolts. The plate 339 is constructed to include a central aperture 341 for passage of material from the airlock port 313 or 315 into the conduit 333 or 331. A baffle 343 extends downwardly from the plate 339 into the baffle tube 337 at the inner margin of one end of the aperture 341. The baffle 343 subtends an angle with respect to the plate 339 of about 30° to about 60°, with a preferred angle of about 45°.

The baffle tube 337 and baffle 343 cooperate to form a throat 345, which creates a low pressure zone, causing cochleation or swirling of the airflow under the airlock port 313 or 315 as depicted in FIG. 13. The low pressure zone also serves to reduce upward dust reflux through the airlock ports 313 and 315. The cochleated airflow entrains introduced material, which facilitates mixing of the material with gaseous air, making the venturi 311 particularly well-suited for use with wet or chunky materials. Because of the laterally expanded configuration of the baffle tube 337, its net diameter exceeds that of the respective conduit leg 331 or 333. Thus, although the dependent baffle 343 occludes a portion of the baffle tube 337, there is no net decrease in the cross sectional area of the conduit 331 or 333. This construction results in a venturi 311 which facilitates introduction of material into the system 301 through a low pressure zone without decreasing throughput capacity.

A control conduit 321 communicates with the air flow conduit first leg 331 via a valve 351. The control conduit also communicates with the lower end of the primary comminuter/dehydrator unit 303 and the material collection unit 323. Airflow through the control conduit 321 is regulated by a pair of control valves 347 which are in electrical communication with particle size and moisture content monitors 349 located in a material collection unit 323. The valves 347 can be actuated electrically, hydraulically, pneumatically or manually.

Similarly, the dampers 317 and 319 maybe adjusted manually by means of hand jacks as in previous embodiments or remotely adjusted by pneumatically, by hydraulic rams, or by jack screws actuated by electric motors 353. It is foreseen that the system can be controlled by a single computer processing unit which receives input from the monitors 349, actuates the control conduit valves 347 and raises and lowers the dampers 317 and 319 to balance airflow and pressure gradients in order to achieve preselected particle size and moisture content of the output material. Alternatively, the system may be controlled by any suitable combination of control systems and human operators.

A collection unit 323 is coupled with the lower end of the secondary comminuter/dehydrator unit 305. The collection unit 323 is equipped with a material removal port 355, which may be coupled with an auger or vacuum device for transporting discharged material for further processing, shipment, or disposal.

A shredding/drying assembly 312 (FIG. 15) is employed for preliminary prepulverizing, sizing, blending and partial dehydration of materials to be processed in the system 301 and includes structure for delivery of the materials into the primary airlock 313. The assembly 312 includes a primary shredder 357, such as, for example, a slow speed shredder, coupled with a conduit 359 equipped with an auger 361 for transporting the shredded material to a secondary shredder 363, for example, a chain shredder. The secondary shredder 363 includes a blower unit 365 adjacent the entrance for supplying a continuous airflow over the material as it is shredded. The secondary shredder 363 is coupled with an elevator conduit 369, having an adjacent outlet 367 to permit removal of dense objects such as stones. The elevator 369 extends upwardly at an angle and terminates in a dependent delivery chute 371, which may be positioned atop the primary material introduction port 313, and may include an auger (not shown) for feeding preshredded and dried material into the comminuting/dehydrating system 301 for processing.

In use, a shreddable or mixable material such as wood waste, animal waste, sea food waste and an absorbent is introduced into the slow speed shredder 357. As the shredder 357 rotates, material falls by gravity into the conduit 359, where it is transported by the auger 361 into the chain/flail shredder-mixer 363 for further reduction in size. The material is partially dehydrated by a continuous stream of air produced by the blower unit 365. The shredded and mixed material is transported from the shredder-mixer unit 363 by the elevator 369. Dense particles are permitted to settle out through the outlet 367. The elevator 369 transports the premixed and semidehydrated material to the primary material introduction port 313 of the comminuter/dehydrator system 301.

The blower unit 307 draws air into the system 301 for circulation at high velocity. Airflow within the comminuter/dehydrator units 303 and 305 is regulated by adjustment of a system of sleeves (not shown in FIG. 12) as previously described, shown and designated by the reference numerals 15 and 115 and dampers 317 and 319, either manually or by hydraulic rams (not shown) or screws actuated by electric motors 353.

Non-viscous materials are introduced into the primary cyclone structure 303 through the primary material introduction airlock port 313. The high velocity airstream generated by the blower unit 307 carries the materials into the upper chamber 325 of the primary cyclone structure 303. The material commences cochleation in the chamber 325 and spirals downwardly into the cone 327. Viscid and liquid materials may be preprocessed in the shredding/drying assembly 312 or they may be introduced through the viscid port 329 directly into the low pressure region of the cyclone structure 303. A quantity of pressurized exhaust air containing extremely fine particles is permitted to pass upwardly through the spent air discharge conduit 335, past the damper 319, through a filter room (not shown) and into the atmosphere.

Comminuted material from the lower body 327 of the primary cyclone structure 303 passes through the secondary material introduction airlock port 315, into the venturi unit 311, which entrains the material in a low pressure, high velocity air stream, and then into the conduit leg 331, where high velocity air from the blower 307 conveys the material into the upper chamber 325 of the secondary cyclone structure 305. In the secondary cyclone structure 305, the material passes as previously described to the lower cyclone body 327, where the low pressure region of the cyclone structure again subjects the material to high velocity air. The comminuted material falls in a stream into a collection unit 323, where the moisture content and particle size of the stream are continuously assessed by monitors 349. The data is used to balance airflow and control the rate of material introduction through the secondary airlock 315. If the selected parameters are exceeded, the dampers 317 and 319 and valves 347 of the control conduit 321 may be adjusted to further comminute and dry the material.

It is also foreseen that material may be transferred from the collection unit via the removal port 355, passed over a scalping screen (not shown), and larger material fed back into the system 301 through the primary material introduction airlock port 313. Those skilled in the art will appreciate that material may be cycled through the system 301 any number of times, and that while a two-stage system 301 has been described herein, additional cyclone structures may be coupled together as described to provide for processing of materials through three or more cyclone structure.

Fully processed material which has been removed through the port 355 and passed through a scalping screen is transported by an auger, conveyor belt or other means to a classification system (not shown), and then to a collection unit (not shown) in order to permit continuous throughput.

In this manner, the two stage comminuter/dehydrator system employs the single blower unit 307 to cycle solid and viscid materials through a pair of cyclone structures 303 and 305 until a predetermined particle size and uniform moisture content are achieved in an energy efficient process.

Such cyclonic comminuter dehydrator units are particularly well adapted for processing methane gas producing animal waste products from feed lot operations such as manure, animal wastes from rendering operations and fish processing such as fish emulsions, for bioremediation by incorporation of minerals and microbes in soil mixtures, for remediation of petroleum and heavy metal-contaminated soil, for landfill remediation, for processing of herbs and medicines, and for enhancing paramagnetism in raw materials. Increased paramagnetic susceptibility is believed to increase crop yields and to enhance fertilizing, herbicide and insecticide application programs.

A method of comminuting and dehydrating a material in accordance with the present invention broadly includes the steps of (a) providing a comminuting/dehydrating system having a pair of cyclone structures coupled with a blower unit by means of a conduit to form an air flow loop from the primary cone bottom to the secondary cone top and from the secondary cone top to the primary cone top, with airflow for cycling material between the cones controlled by feedback from moisture and particle size monitoring devices, (b) causing airflow from the blower to flow through the apparatus, (c) feeding material into the primary cyclone structure through an airlock valve for comminution and dehydration, (c) regulating the air flow in the system by adjusting a system of dampers, sleeves The comminuter/dehydrator system 301 and method may be employed to enhance the absorption properties in certain materials such as glauconite or greensand following processing. Glauconite processed in the present system 301 has been shown to demonstrate increased capacity for absorption of iron, manganese, hydrogen sulfide, radium, arsenic and lead from well water supplies. Processed rocks and other dense substances have also demonstrated increased magnetic susceptibility.

The system may also be employed to decontaminate materials contaminated with heavy metals. Addition of a mixture of zeolite and glauconite to comminuted/dehydrated materials appears to encapsulate heavy metals.

By processing hydrocarbon contaminated soil in the comminuter/dehydrator system 301 the surface area of the particles per unit mass is increased and the particles are subject to evaporative air in the low pressure zone of the cyclone structures 303 and 305.

EXAMPLE 1

Mined materials such as rock, ore or coal containing minerals may be subjected to crushing forces by a jaw crusher (not shown) to a particle size of one half inch or less. The crushed material is passed over a trommel (not shown) for sorting and removal of foreign material. The screened material is next fed into a two-stage comminuting/dehydrating system 301 through the primary airlock. The material is passed through the primary and secondary cyclone structures 303 and 305, during which passage the airflow through the unit is adjusted to produce a particle screen mesh size of 50 to 600 which is dehydrated to a uniform moisture level. The processed material is suitable for use as a remineralizing soil amendment.

EXAMPLE 2

The system 301 is particularly well-adapted for processing liquids or slurries consisting of emulsions of fish and/or animal waste. Waste emulsion is first mixed with a predetermined quantity of a zeolite or other absorbent material to form an admixture. The material is permitted to stand for about 24 to about 48 hours to permit the zeolite to absorb some of the odor and moisture content. The premixed material is then introduced into the slow-speed shredder 357. The resultant mix is then introduced into the two stage comminution/dehydration system 301 and processed until the moisture content is reduced to between about 8% and about 10%. The substantially dry particulate product may then be screened for use as a soil amendment.

EXAMPLE 3

The system 301 may be used to admix various materials for soil remineralization. For example, a golf course top dress material maybe formulated by blending 300 pounds greensand, 300 pounds basalt clay with 400 pounds of 40 mesh river sand and 500 pounds of barn yard manure and 500 pounds of spent compost. Following processing through the two stage comminuter/dehydrator system 301, the material forms a homogenous mixture having a consistent, predetermined moisture level, and it may be and screened to a predetermined size.

EXAMPLE 4

Various materials were shredded or crushed to achieve a particle size screenable to one/half inch. Each material was tested using a Paramagnetic Susceptibility Meter obtained from Pike Agri-Lab Supplies, Inc., Strong, Me. The material was next fed into a two-stage comminuting/dehydrating system through the primary airlock. The material was passed through the primary and secondary cyclone structures, during which passage the airflow through the unit is adjusted to produce a particle size passable through a 50 to 600 mesh screen which was dehydrated to a uniform moisture level. The processed material was tested using the same Paramagnetic Susceptibility Meter. The results are summarized as follows.

TABLE 4

| Relative Paramagnetic Susceptibility | | |
|---|---|---|
| Material | Unprocessed | C/D Processed |
| Red lava | 550 | 1,700 |
| Greensand | 70 | 120 |
| Red Sand | 0 | 540 |
| River Sand | 20 | 1,130 |
| Bio-Solids | 10 | 100 |
| Vulcanite | 2,800 | 7,300 |
| Basalt Mill Sand | 4,900 | 9,800 |
| Basalt Clay | 3,900 | 6,000 |
| Granite | 50 | 3,200 |
| Wheat Seed | 30 | 1,320 |

It is to be understood that while certain forms of the present invention have been illustrated and described herein, it is not to be limited to the specific forms or arrangement of parts described and shown.

What is claimed and desired to be secured by Letters Patent is as follows:

1. A two stage system for comminuting and dehydrating a material and comprising:

(a) a first cyclone structure having a first material outlet;

(b) a second cyclone structure;

(c) a blower unit;

(d) a conduit assembly forming an air flow path from said blower unit past said first material outlet to said second cyclone structure and to said first cyclone structure; and (e) a material entry port communicating with said conduit assembly between said second cyclone structure and said first cyclone structure whereby material received through said material entry port is entrained in air flow through said conduit assembly, carried to said first cyclone structure for a first stage of comminution and dehydration therein, again entrained in air flow in said conduit assembly, and carried to said second cyclone structure for a second stage of comminution and dehydration therein.

2. The system as set forth in claim 1, wherein said blower unit comprises a single blower.

3. The system as set forth in claim 1, wherein each of said cyclone structures further includes an upper chamber and a lower body.

4. The system as set forth in claim 1, wherein said system further includes a venturi assembly positioned between said first cyclone structure and said conduit assembly and between said conduit assembly and said material entry port.

5. The apparatus as set forth in claim 4 wherein said venturi assembly further includes:

(a) a laterally expanded baffle tube;

(b) a baffle dependently coupled with said baffle tube;

(c) said baffle and said baffle tube cooperatively forming a throat having a low pressure area; and (d) said throat presenting a cross sectional area at least about equal to a cross sectional area of said conduit assembly, for permitting rapid passage of material through said low pressure area.

6. The system as set forth in claim 1, wherein each of said cyclone structures further includes a viscid material entry port for permitting addition of viscid material to be comminuted and dehydrated.

7. The system as set forth in claim 1, wherein said system further includes a shredding and drying assembly having:

(a) a first shredder having an outlet;

(b) a second shredder having an inlet and an outlet; and (c) a conduit coupling said first shredder outlet with said second shredder inlet and said second shredder outlet with said material entry port.

8. A two stage system for comminuting and dehydrating a material and comprising:

(a) a first cyclone structure and a second cyclone structure;

(b) a blower unit;

(c) a first conduit communicating between said blower unit and said second cyclone structure;

(d) a second conduit communicating between said second cyclone structure and said first cyclone structure;

(e) said first cyclone structure having a first material outlet communicating with said first conduit between said blower unit and said second cyclone structure;

(f) said first conduit and second conduit cooperating with said blower unit and said first cyclone structure and said second cyclone structure to form an air flow path from said blower unit through said second cyclone structure to said first cyclone structure; and (f) a material entry port communicating with said second conduit between said second cyclone structure and said first cyclone structure whereby material received through said material entry port is entrained in air flow through said second conduit, carried to said first cyclone structure for a first stage of comminution and dehydration therein, entrained in air flow in said first conduit through said first material outlet, and carried to said second cyclone structure for a second stage of comminution and dehydration therein.

9. The system as set forth in claim 8, wherein said blower unit comprises a single blower.

10. The system as set forth in claim 8, wherein each of said cyclone structures further includes an upper chamber and a lower body.

11. The system as set forth in claim 8, wherein said system further includes a venturi assembly positioned between said first cyclone structure and said conduit assembly and between said conduit assembly and said material entry port.

12. The system as set forth in claim 8, wherein each of said cyclone structures further includes a viscid material entry port for permitting addition of viscid material to be comminuted and dehydrated.

13. The system as set forth in claim 8, wherein said system further includes a shredding and drying assembly having:

(a) a first shredder having an outlet;

(b) a second shredder having an inlet and an outlet; and (c) a conduit coupling said first shredder outlet with said second shredder inlet and said second shredder outlet with said material entry port.

14. A system for comminuting and dehydrating material, comprising:

(a) first and second cyclone structure, each having:

(1) a cylindrical chamber presenting a diameter;

(2) a body having an inverted, conically shaped cavity presenting an open truncated lower end; said body being coupled with said chamber in suspended relationship; said cavity having a base coupled with said chamber, said base presenting a diameter substantially equal to the diameter of said chamber;

(3) a first material entry port for introducing material to be comminuted and dehydrated into said first cyclone structure;

(4) said first cyclone structure having a first material outlet and said second cyclone structure having a second material outlet;

(5) a second material entry port coupled with said first material outlet for introducing material comminuted and dehydrated by said first cyclone structure into said chamber of said second cyclone structure;

(5) a collection unit coupled with said second material outlet; said unit including a moisture sensor;

(b) a blower unit;

(c) a conduit assembly forming an air flow path from said blower unit past said first material entry port to said second cyclone structure and then to said first cyclone structure; and (d) a control conduit intercoupling said conduit and said first and second cyclone material outlets; said moisture sensor operatively coupled with said control conduit for selectively controlling the delivery of air to said material outlets.

15. The apparatus as set forth in claim 14 wherein said conduit assembly further includes a venturi assembly positioned between said first cyclone structure and said conduit assembly and between said conduit assembly and said material entry port.

16. The apparatus as set forth in claim 15 wherein said venturi assembly further includes:

(a) a laterally expanded baffle tube;

(b) a baffle dependently coupled with said baffle tube;

(c) said baffle and said baffle tube cooperatively forming a throat having a low pressure area; and (d) said throat presenting a cross sectional area at least about equal to a cross sectional area of said conduit, for permitting rapid passage of material through said low pressure area.

17. The system as set forth in claim 14, wherein said system further includes a shredding and drying assembly having:

(a) a first shredder having an outlet;

(b) a second shredder having an inlet and an outlet; and (c) a conduit coupling said first shredder outlet with said second shredder inlet and said second shredder outlet with said material entry port.

18. A method for comminuting and dehydrating material comprising the steps of:

(a) providing an apparatus having:

(1) a first cyclone structure having a first material outlet;

(2) a second cyclone structure;

(3) a blower unit;

(4) a conduit assembly forming an air flow path from said blower unit past said first material outlet to said second cyclone structure and to said first cyclone structure;

(5) a material entry port communicating with said conduit assembly between said second cyclone structure and said first cyclone structure;

(b) causing airflow from said blower unit to flow through the apparatus; and (c) introducing material through said material entry port for entrainment in air flow through said conduit assembly to said first cyclone structure for a first stage of comminution and dehydration therein, entrainment in air flow in said conduit assembly to said second cyclone structure for a second stage of comminution and dehydration therein.

* * * * *